US006093233A

United States Patent [19]

Magnin

[11] Patent Number: 6,093,233

[45] Date of Patent: Jul. 25, 2000

[54] FERRITIC STAINLESS STEEL AND EXTERNAL PART FOR A WATCH MADE THEREOF

[75] Inventor: Pierre Magnin, Cugy, Switzerland

[73] Assignee: Asulab S.A., Bienne, Switzerland

[21] Appl. No.: 09/329,793

[22] Filed: Jun. 10, 1999

[30] Foreign Application Priority Data

Jun. 12, 1998 [CH] Switzerland ..... 1280/98

[51] Int. Cl.[7] ..... C22C 33/02

[52] U.S. Cl. ..... 75/244; 75/246; 420/65; 420/67

[58] Field of Search ..... 420/65, 67; 75/246, 75/244

[56] References Cited

U.S. PATENT DOCUMENTS 4,140,526 2/1979 Moroishi et al. .
4,340,424 7/1982 Katoh et al. .

*Primary Examiner*—Ngoclan Mai
*Attorney, Agent, or Firm*—Sughrue, Mion, Zinn, Macpeak & Seas, PLLC

[57] ABSTRACT

The invention concerns a nickel free stainless steel alloy having a ferritic and magnetic structure, characterised in that it contains at least 0.4% in weight of nitrogen, and at most 0.5% in weight of nickel, the remainder being formed of iron and the inevitable impurities. The invention also concerns an external part for a watch made of such a steel alloy.

5 Claims, No Drawings

FERRITIC STAINLESS STEEL AND EXTERNAL PART FOR A WATCH MADE THEREOF

The present invention concerns a nickel free ferritic stainless steel, and an external part for a watch.

Iron, which is the basic element of all steels, has the drawback of being susceptible to corrosion. In order to overcome this drawback, it has been known for a long time that it is possible to make it stainless by alloying it with a certain quantity of chromium and, if required, molybdenum, these elements spontaneously forming a protective oxide film at the surface of the metal. Compositions of this type lead to a ferritic structure, identifiable in particular by the fact that the alloy thereby obtained is ferromagnetic, i.e. it is attracted by magnets. However, one often wishes to obtain an austenitic structure. This structure is in fact known for having better properties than the ferritic structure, in particular as regards resistance to corrosion, and for not being magnetic. For this purpose, it is then necessary to add an additional alloy element, capable of stabilising the austenite. In most cases, this alloy is nickel.

Nonetheless, when these alloys are used to make objects, such as for example, external parts for watches, which can be in prolonged contact with the skin, the presence of nickel poses a problem because of the well known allergenic effects thereof. For these applications, it has thus been sought to replace the nickel with another alloy element also able to stabilise the austenite. Various authors have proposed replacing nickel with nitrogen. The solubility of nitrogen in iron is however insufficient to obtain the austenite, i.e. the desired stabilisation of the austenite. It is nonetheless possible to increase this solubility by adding a certain quantity of manganese to the alloy, which can then become austenitic.

By way of example, German Patent No. 195 13 407 wherein Uggowitzer et al propose an austenitic stainless, non magnetic alloy containing no nickel, is known. This alloy is based on the Fe—Cr—N—Mn system. Such an alloy can however only be obtained if a heat treatment is effected within a narrow temperature range. Indeed, if the treatment temperature is too low, chromium nitride precipitates form, which destroy the corrosion resistance properties of the alloy. Conversely, if the treatment temperature is too high, the desired austenitic structure does not form. This latter constraint is particularly inconvenient when these alloys are formed by powder metallurgy, a technique which is increasingly used for the manufacture of small parts of complex shape, such as watch cases. Indeed, this technique requires a high sintering temperature to make dense parts, which are free of porosity. This sintering temperature is generally very close to, or even higher than the maximum admissible temperature for obtaining an austenitic structure. It is thus difficult, even impossible, in industrial conditions, to obtain parts which have a low porosity and an austenitic structure after sintering. One could, possibly, envisage first effecting sintering at a high temperature, to obtain parts which have a low porosity, then a subsequent heat treatment at a lower temperature, to form the austenitic structure. However, in addition to the additional costs which this double treatment would involve, experience has shown that it is very difficult to reform austenite on a part having a ferritic structure formed at a high temperature.

An object of the present invention is thus to overcome the above problems and drawbacks, by providing a steel which does not have any allergenic nature, which is resistant to corrosion and can advantageously be shaped by powder metallurgy.

The present invention therefore concerns a stainless steel alloy having a ferritic and magnetic structure, characterised in that it contains at least 0.4% in weight of nitrogen, and at most 0.5% in weight of nickel, the remainder being formed of iron and the inevitable impurities.

Advantageously, the steel alloys selected will have a composition comprised within the following limits:

between 10 and 35% in weight for the total of chromium and molybdenum, and between 5 and 20% in weight of manganese.

The invention also concerns such a steel alloy made by powder metallurgy.

The invention finally concerns an external part for a watch made of such a steel alloy.

In order to understand properly the features of the present invention, the conditions which prevailed during the implementation thereof must be recalled. Instead of starting with an austenitic corrosion resistant stainless steel, and replacing the nickel with another austenite stabilising element, the present invention proposes starting with a nickel free ferritic structure, whose resistance to corrosion is known to be less good, and improving such resistance to corrosion in an entirely original way, by adding new alloy elements and keeping the ferritic structure.

It is known that it is not possible to increase the corrosion resistance of a ferritic structure simply by increasing the percentage of chromium and molybdenum in the alloy. Indeed, higher levels than those usually used (more than 25% in weight of chromium or more than 10% in weight of molybdenum) rapidly lead to the formation of inter-metallic phases which produce alloys with extremely poor mechanical properties and machinability.

The Applicant has observed that, among the elements capable of improving the resistance of ferritic alloys to corrosion, one efficient element for achieving this aim is nitrogen.

Thus the alloy which forms the subject of the present invention is an iron, chromium, manganese and nitrogen based ferritic alloy. It will be noted that if the composition of the alloy according to the invention is similar to certain compositions of the prior art, the ferritic and magnetic structure thereof is completely different, and results in extremely advantageous new properties. In particular, it is to be noted that, unlike the austenitic alloys of the prior art, the alloy according to the invention is magnetic, i.e. it is attracted by magnets. This property is particularly advantageous when the invention is applied to watch cases. Indeed, mechanical clockwork movements are particularly sensitive to magnetic fields, and a case made of a magnetic alloy can constitute a shield against external magnetic fields. It is however imperative that this magnetism is low, i.e. no residual magnetisation persists in the alloy when it is no longer subject to an external magnetic field. It has been confirmed that the alloy according to the invention has no residual magnetisation, even after having been subjected numerous times to a magnetic field of five Tesla, a thousand times stronger than the magnetic fields ordinarily used for testing clockwork movements. Unlike other magnetic alloys which are capable of having slight residual magnetisation and which, for this reason, are not used in watchmaking, the magnetic nature of the alloy according to the invention thus constitutes an advantage for horological applications.

Another advantage of the alloy according to the invention lies in the removal of the maximum treatment temperature constraint imposed on alloys of the prior art, in particular when powder metallurgy is used. Indeed, according to the invention, in order to achieve the desired ferritic structure, a high temperature is required, perfectly compatible with the sintering temperature necessary for obtaining dense parts, which have no porosity.

Another advantage of the alloy according to the invention lies in the fact that the quantity of nitrogen and manganese added can be reduced to the minimum necessary to obtain sufficient corrosion resistance for the application concerned, while a high concentration is indispensable to obtain alloys having an austenitic structure. It is thus possible to make alloys having much better machinability than that of nitrogen and manganese rich alloys, such elements being known to considerably increase the hardness, resistance and strength of the alloy.

If the quantity of nitrogen which the alloy is capable of containing in solution is too low to improve the corrosion resistance sufficiently, it can be increased by adding manganese which, as in the case of austenitic structures, also allows the solubility of nitrogen to be improved in the ferritic structure of the desired alloy.

An example of an alloy according to the invention and the embodiment thereof will now be described with reference to a fine powder formed of 16.91% in weight of chromium, 3.61% in weight of molybdenum, 11.92% in weight of manganese, 0.37% in weight of silicon, 0.03% in weight of nickel and the remainder of iron.

This powder is mixed with an organic binder in proportions of 60% of powder volume for 40% of binder volume, and injected in accordance with the MIM (Metal Injection Moulding) process. The parts thereby obtained are freed of their binder by a thermochemical process called debinding, and sintered in a formiergas atmosphere comprising 8% of hydrogen and 92% of nitrogen, at a temperature of 1350° C. for one hour. During sintering, the nitrogen quickly diffuses in the alloy, until the concentration thereof reaches around 1% in weight, which is confirmed by chemical analyses subsequently effected on samples thereby obtained. The parts obtained are dense (only around 0.1% porosity) and magnetic, indicating that their structure is ferritic. In order to make a non magnetic austenitic structure, with the same composition, a maximum sintering temperature of 1275° C. would have to be used. In such conditions, the porosity of the parts obtained is 1%, and even 4% for a sintering temperature of 1265° C. This porosity would be unacceptable for making a watch case, and such sensitivity to the sintering temperature would not be compatible with industrial manufacturing conditions.

The ferritic parts obtained by means of the alloy according to the invention have been subjected to a corrosion test consisting of dipping them for seventy two hours in a fog made from salt water, then putting them in a solution of synthetic sweat for seventy two hours. After the test, the parts do not show the slightest trace of corrosion, indicating that, unlike most other ferritic steels, their resistance to corrosion is at least as good as that of a good austenitic stainless alloy. This is due to the presence of nitrogen and manganese which improve the ferritic phase properties.

A mechanical clockwork movement was mounted in a watch case made by means of the alloy according to the invention. The standard watchmaking test of resistance to magnetic fields showed a beneficial shield for the movement in the presence of an external magnetic field. No detrimental effect of the magnetic alloy on the working of the clockwork movement was observed, even after having subjected the case to fields of five Tesla, one thousand times stronger than the magnetic fields normally used.

It goes without saying that various simple variants and modifications fall within the scope of the present invention.

What is claimed is:

1. A stainless steel alloy having a ferritic and magnetic structure, containing at least 0.4% in weight of nitrogen, and at most 0.5% in weight of nickel, the remainder being formed of iron and the inevitable impurities.

2. A steel alloy according to claim 1, containing between 10 and 35% in weight for the total of chromium and molybdenum.

3. A steel alloy according to claim 1, containing between 5 and 20% in weight of manganese.

4. A steel alloy according to claim 1, wherein it is made by powder metallurgy.

5. An external part for a watch made of a steel alloy according to claim 1.

* * * * *